US007485081B2

(12) United States Patent
Brooks

(10) Patent No.: US 7,485,081 B2
(45) Date of Patent: Feb. 3, 2009

(54) ROLL 'N' TONE

(76) Inventor: Richard Dwight Brooks, 325 Debric La., Mount Hope, WV (US) 25880

( * ) Notice: Subject to any disclaimer, the term of this patent is extended or adjusted under 35 U.S.C. 154(b) by 0 days.

(21) Appl. No.: 11/373,039

(22) Filed: Mar. 13, 2006

(65) Prior Publication Data

US 2007/0219077 A1 Sep. 20, 2007

(51) Int. Cl.
*A63B 71/00* (2006.01)

(52) U.S. Cl. ..... 482/148; 280/249

(58) Field of Classification Search ..... 482/61, 482/65, 114–115, 118, 904, 44, 132, 148, 482/51, 130; 280/249–250.1, 304.1, 304
See application file for complete search history.

(56) References Cited

U.S. PATENT DOCUMENTS 3,572,758 A * 3/1971 Lee ..... 280/296
4,966,362 A * 10/1990 Ramaekers ..... 482/148
5,643,143 A * 7/1997 Burak et al. ..... 482/54
5,649,883 A * 7/1997 Mayes et al. ..... 482/54
6,048,292 A * 4/2000 Gasquez ..... 482/130
6,857,992 B1 * 2/2005 Kolda et al. ..... 482/61

* cited by examiner

*Primary Examiner*—Lori Amerson

(57) ABSTRACT

This is a portable exercise unit used in conjunction with a wheelchair that includes a frame, two rollers, and a tension control unit. The frame is adapted to fit over a wheelchair tire on one end and adapted to hold the two rollers on the other end. Each of the two rollers have a bearing in the center, one a non-directional bearing that is placed in the front of the frame and the other a clutch bearing that only turns in one direction placed in the back of the frame, and two axles, one for each roller with two washers on each axle. The roller assemblies are held in the frame with four clips. Also, within the frame there is a place provided for an adjustable tension control unit that includes an attachable felt pad.

1 Claim, 3 Drawing Sheets

ROLL 'N' TONE

CROSS-REFERENCE TO RELATED APPLICATIONS

Not applicable to this application

STATEMENT REGARDING FEDERALLY SPONSERED RESEARCH OR DEVELOPMENT

Not applicable to this application

REFERENCE TO MICROFICHE APPENDIX

Not applicable to this application

BACKGROUND OF THE INVENTION

1. Field of the Invention

The present invention relates generally to exercise systems, and more specifically it relates to a portable exercise system designed to adapt a conventional wheelchair for use as a stationary exerciser, facilitating exercise of arms and upper body without requiring any modifications to the wheelchair.

2. Description of Related Art

People are confined to wheelchairs for various health reasons, such as paralysis or strokes. Hospitals and healthcare centers provide the necessary rehabilitation for these people to return home as physically independent as possible. Maintaining this independence requires maintaining upper body strength to push the wheelchair. Most people return to a home with limited space to push the wheelchair for exercise and limited funds to be able to join a gym with exercise facilities comparable those at the hospitals and healthcare centers.

Home exercise systems for building and maintaining upper body strength for pushing a wheelchair, by pushing the wheelchair, has been limited for years to treadmill exercise systems. These systems allow the user to target the necessary muscles needed to push the wheelchair, but several problems exist for the user with these systems. (1) They are expensive. This limits the availability of the system to those with money or good health insurance. (2) They require a lot of floor space. Floor space needed for these systems includes the size of the system and the floor space needed for the user to mount the system. (3) They are heavy. This makes it difficult for someone in a wheelchair to move, making them stationary systems. (4) They apply equal tension resistance to both arms at the same time. This makes these exercise systems difficult to use when one arm is weaker than the other, as is the case in many stroke patients.

There exists a need in the art for a system that allows a person confined to a wheelchair to achieve an upper body workout, and which addresses the above stated problems found in the art. Such a system must: (1) be simple in design and construction so that the system can be relatively inexpensively manufactured, (2) be relatively small and of a lightweight material so the system can be stored easily by the user in a small space and not require a permanent floor space, and (3) have a means to apply the amount of tension resistance to the arms individually in the event that one of the arms is weaker than the other.

Therefore, it is desirable to provide an exercise system that satisfies the three aforesaid needs of an exercise system to eliminate the four problems cited previously pertaining to the conventional wheelchair exercise treadmill.

BRIEF SUMMARY OF THE INVENTION

It is the object of the present invention to provide an exercise system which enables a wheelchair occupant to adapt their wheelchair to a stationary exerciser, as a means to perform useful and satisfying exercise to maintain upper body strength, without requiring modifications to the wheelchair.

It is also the object of the present invention to provide an exercise system that overcomes the existing problems related with a wheelchair treadmill exercise system by satisfying the following three needs:

1—There needs to be an exercise device simple in design so manufacturing will be relatively inexpensive to make it affordable for the general public.

2—There needs to be an exercise device small in size and lightweight to (1) make it portable so the user can pick it up to change locations to exercise and (2) do away with the need for using a large amount of floor space for an exercise system.

3—There needs to be an exercise device that allows the amount of tension resistance to be applied to the arms individually in the event one arm is stronger than the other.

DETAILED DESCRIPTION OF THE INVENTION

Features and advantages of the present invention will become apparent in the detailed description of the preferred embodiment with reference to the accompanying drawings. But, before explaining the embodiment of the invention in any detail, it is to be understood that the invention is not limited to the details of construction, or the arrangements of the components. The invention is capable of other embodiments. Also, it is to be understood that the phraseology and terminology employed herein are for the purpose of description and should not be regarded as limiting.

Figure 9:
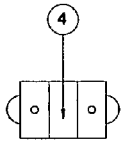
FIG. 9 is a top view of the axle clip.
Figure 10:
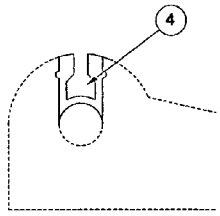
FIG. 10 is a cross-sectional side view of the axle clip in the frame.
Figure 11:
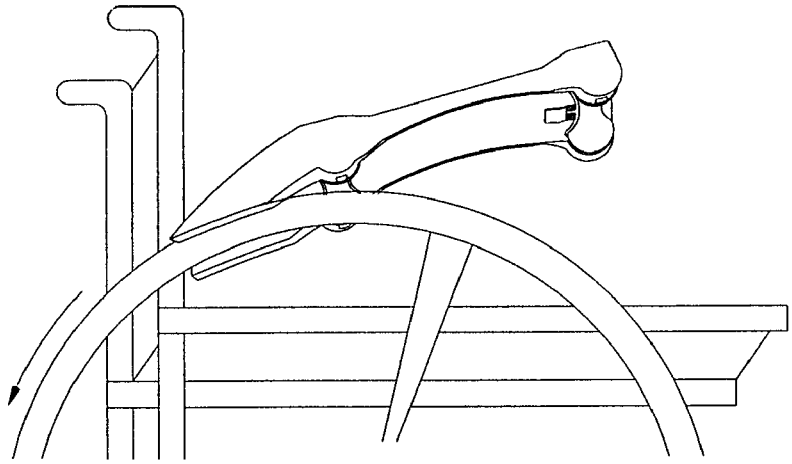
FIG. 11 is a view showing how to attach the invention to the wheelchair tire.
Figure 12:
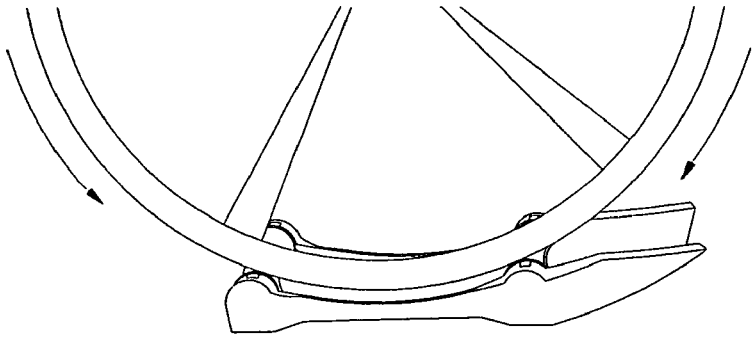
FIG. 12 is a view showing push directions for exercise use and dismount of the invention.

The detailed descriptions of the drawings are respectively separated into two sections, (1) is the preferred embodiment of the invention as illustrated in FIGS. 1-10, and (2) is using the invention as illustrated in FIGS. 11-12.

(1) The preferred embodiment of the invention, FIGS. 1-10.

Figure 1:
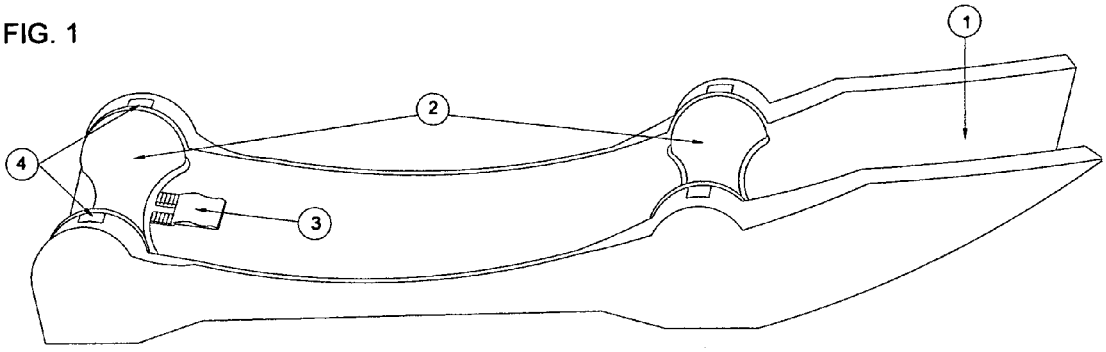
FIG. 1 is a view of a preferred embodiment of a portable exercise unit according to the present invention.

FIG. 1 is a view of the four basic components that make up the invention; 1 is the frame, 2 the rollers, 3 the tension control unit, and 4 the axle clips.

The frame 1 has an approximate size of 2" wide and 16" long as seen in FIG. 11 showing it capped over a standard 1⅜"×24" wheelchair tire and FIG. 12 showing it under a standard wheelchair tire.

There are two sections to the frame, the front section, the section that attaches to the wheelchair tire as seen in FIG. 11, and the back section, the section that holds the rollers, as seen in FIG. 1.

The front section of the frame: The bottom of this section arcs from the extreme front down to the bottom of the front end of the back section as seen in FIG. 1. The top has an arc along the centerline lengthwise and circular sides that form a cradle for the wheelchair tire. The dimensions for the arc and circular sides are determined by the wheelchair tire size so this section will attach to the wheelchair tire as seen in FIG. 11. For example: a standard pneumatic wheelchair tire is 1⅜"×24." The front section of the frame for this tire would have a radius of 12" along the centerline lengthwise, circular sides with a radius of ⅝," and a center depth of ¾."

Figure 6:
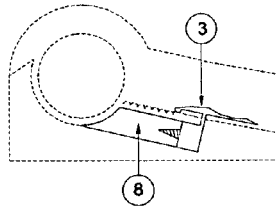
FIG. 6 is a cross-sectional side view of the tension control unit inside the frame.

The back section of the frame: The bottom of this section is flat. The top has an arc and circular sides as seen in FIG. 1, these are for cosmetic value only of the invention and not to be construed as the only embodiment shape of the invention. The top section also includes two cavities for the rollers 2, one cavity for the tension control unit 3, and four slots for the axle clips 4 as seen in FIGS. 1, 6, and 10.

Figure 2:
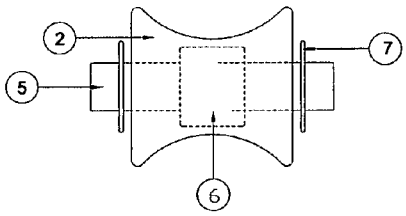
FIG. 2 is a detailed view of the roller assembly.
Figure 3:
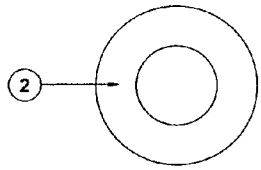
FIG. 3 is an end view of the roller.

FIG. 2 is a detailed view of the roller assembly. The roller 2 is arced on the surface to cradle the wheelchair tire and as seen in FIG. 3 the ends are round and there is a hole through the center for the axle 5 and bearing 6 to go through. The bearings 6 are in the center of the rollers. The front roller has a non-directional bearing that turns forwards or backwards and the back roller has a clutch bearing that turns in one direction only.

To complete the roller assembly, a bearing 6 is first pressed in the roller or made a part of the roller in the initial molding of the roller, then an axle 5 is inserted through the center of the roller 2 and a flat washer 7 is placed on each end. The rollers are then put into the axle slots as seen in FIG. 1. When placing the back roller in the frame, the one with the clutch bearing, place it so that when the wheelchair tire is being pushed forward it rolls freely for exercising and when the tire is pushed backwards the roller locks up for dismounting the invention as seen in FIG. 12.

Figure 4:
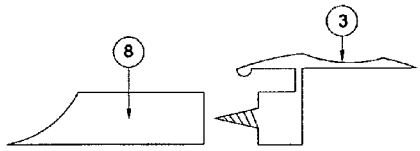
FIG. 4 is a detailed side view of the tension control unit.

FIG. 4 is a detailed view of the tension control unit. The tension control unit 3 is a cube with a screw end projecting out one side and a stem projecting from the top that extends through the top of the frame to slide along the slide bar on the top as seen in FIG. 6.

A felt pad 8 with the same end dimensions as the tension control unit cube and approximately 1½" in length is screwed onto the screw of the control unit. The control unit is then slid into the cavity of the frame as seen in FIG. 6.

Figure 7:
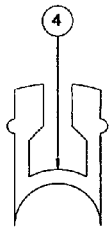
FIG. 7 is a side view of the axle clips.
Figure 8:
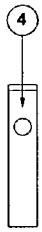
FIG. 8 is an end view of the axle clip.

FIGS. 7, 8, and 9 are detailed side, end, and top views of the axle clips.

FIG. 10 is a cross-sectional side view of the axle clip in the frame. The dimensions of the axle clip are seen here to be the same width as the diameter of the axle and the height is from the top of the frame to mid-axle.

The axle clip has a slot in the center as seen in FIGS. 7, 9, and 10. This allows the axle clip to be squeezed together to draw the side protrusions in when putting the clip in the frame or taking it out.

(2) Using the invention, FIGS. 11 and 12.

FIG. 11 is a view showing how to attach the invention to the wheelchair tire. The frame is turned bottom-side up with the back end of the frame facing away from the wheelchair. Cap the front end of the frame over the tire and push down until the tire rests in the cradle.

There are two units of the invention needed for exercise. Attach the second unit the same way as the first. With the units in place roll backwards until the tire leaves the front end of the frame and drops into the back end of the frame on the rollers as seen in FIG. 12.

FIG. 12 is a view showing push directions for exercise use and dismount of the invention. When the tires are being pushed in a clockwise direction, forward, the chair remains stationary for exercise. When the tires are pushed in a counter-clockwise, backwards, direction the clutch bearing in the roller locks up and allows the tires to come over the back roller for dismounting the invention.

Figure 5:
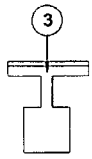
FIG. 5 is an end view of the tension control unit.

Use the tension control unit FIGS. 4, 5, and 6 to increase the resistance against the roller for a harder workout. To increase the resistance on the roller push down on the back of the tension control unit 3 and push toward the roller, release and it will lock into one of the grooves on the top of the frame as seen in FIG. 6.

From the previous detailed descriptions of FIGS. 1-12 of the invention the features and advantages of the invention are seen in its simplicity of design, portability, and use.

What is claimed is:

1. In combination, a portable exercise unit and a wheelchair, said portable exercise unit comprising: a frame with one end adapted to fit over a tire of said wheelchair and the other end adapted to hold two rollers; two rollers with a bearing in the center of each, one a non-directional bearing and the other a clutch bearing that only turns in one direction; two axles, one for each roller with two washers on each axle; an adjustable tension control unit with an attachable felt pad; and four clips to secure the axles.

* * * * *